United States Patent [19]

Schumann

[11] Patent Number: 4,607,830

[45] Date of Patent: Aug. 26, 1986

[54] LENGTHWISE FOLDING ARRANGEMENT WITH VERTICALLY ADJUSTABLE CONICAL TIP FOLDING MANDREL

[75] Inventor: Roland Schumann, Leipzig, German Democratic Rep.

[73] Assignee: Veb Kombinat Polygraph "Werner Lamberz" Leipzig, Leipzig, German Democratic Rep.

[21] Appl. No.: 693,802

[22] Filed: Jan. 22, 1985

[30] Foreign Application Priority Data

Jan. 20, 1984 [DD] German Democratic Rep. ... 259504

[51] Int. Cl.[4] ..... B41L 43/04

[52] U.S. Cl. ..... 270/41; 226/197; 226/199

[58] Field of Search ..... 270/40–41, 270/5; 226/197, 199; 493/438–440

[56] References Cited

U.S. PATENT DOCUMENTS

| | | | |
|---|---|---|---|
| 3,817,514 | 6/1974 | Nissen et al. | 270/40 |
| 4,187,968 | 2/1980 | Winterholler et al. | 226/197 X |
| 4,365,395 | 12/1982 | Brantley | 226/197 X |
| 4,420,148 | 12/1983 | Meadows | 270/41 |
| 4,502,675 | 3/1985 | Clark et al. | 270/41 X |

*Primary Examiner*—E. W. Eickholt

*Attorney, Agent, or Firm*—Michael J. Striker

[57] ABSTRACT

A lengthwise folding arrangement for webs has a drawing-in roller, a horizontal guiding plate which forms a folding edge, a folding mandrel arranged under a plane of a web edge extending between the drawing-in roller and a withdrawing roller, a conical tip provided on the folding mandrel forming a harmonous transition to the folding edge of the guiding plate, and a guiding rod extending over the guiding plate diagonally to the folding mandrel to the rear side of the line of intersection of the edge and the withdrawing roller.

9 Claims, 4 Drawing Figures

LENGTHWISE FOLDING ARRANGEMENT WITH VERTICALLY ADJUSTABLE CONICAL TIP FOLDING MANDREL

BACKGROUND OF THE INVENTION

The present invention relates to a lengthwise folding arrangement, particularly for webs which are taken from a roller rotary printing machine and supplied to a rotary folder, a transverse cutter and the like.

Lengthwise folding arrangement in which more or less small partial strip changes its path are also known as plow folding arrangements in strands folding arrangement. Such an arrangement is disclosed, for example, in the U.S. Pat. No. 3,799,536. In this arrangement a laterally adjustable and substantially horizontal guiding plate is mounted on two blocks so that it extends only in accordance with the predetermined turning or folding width in the plane of the paper web. The web is guided from a drawing-in roller which is arranged higher, over a front side of the laterally adjustable guiding plate provided with a curvature, and is folded with the aid of a rounded corner provided on the plate curvature in a plow-like manner over the longitudinal edge of the guiding plate. The part of the web which is not guided under the guiding plate is first partially and then fully turned and pressed on the upper side of the plate by an adjustable tubular guiding roller. The not folded part of the web is guided under the plate curvature toward the lower side of the guiding plate. The web is then withdrawn either by the driven withdrawing roller or by the subsequent aggregates.

This construction possesses the disadvantage that the geometrical form of the plow-corner of the plate curvature is always fixed and cannot be adjusted in its shape to the different thicknesses or types of the paper to be treated. Moreover, the pressing by the paper guiding roller which operates shortly behind the plow-like corner leads to the fact that the turned part of the web is folded over a very short path which leads to a forced running connected with high pulling stresses and thereby to overextension of the web in the folding region. The extremely differing web expansion of the folded part of the web and the part of the web guided onto the adjustable plate obtains for many types of paper folds and other problems with which the further treatment of the entire web is performed not simultaneously as desired or after the folding separation by cutting of the part of the web takes place. For production of folded or partially folded advertising printing matter, etc. these arrangements are not suitable. Also, the required accuracy of the folding line is not achieved, since the very short-distance turn of the part of the web can lead to buckling of the web.

The U.S. Pat. No. 4,052,048 shows an arrangement for lengthwise folding of the webs, which is provided with an adjustable guiding rod extending substantially diagonally over the folding plate and used for example for zig-zag folding of fabric webs and other webs which are to be treated so as to form towels, napkins and the like. The U.S. Pat. No. 4,047,711 discloses a plow-folding arrangement with a folding device which is easily adjustable and displaceable during running of the web. However, it has the disadvantage of the unchangeable geometrical form of the corner of the plate curve, on the one hand, and its manufacture and maintenance is very complicated and expensive on the other hand.

SUMMARY OF THE INVENTION

Accordingly, it is an object of the present invention to provide a lengthwise folding arrangement which avoids the disadvantages of the prior art.

More particularly, it is an object of the present invention to provide a lengthwise folding arrangement which can be easily adjustable to paper of different types, which provides for an easy and fine adjustability of the folding width, and with which a high quality of the lengthwise fold can be achieved.

In keeping with these objects and with others which will become apparent hereinafter, the lengthwise folding arrangement in accordance with the present invention is designed so that in order to avoid flexture formations, fold inaccuracies and the like, the adjustability of fold-forming elements is provided so that the web tensions in the web and in the folding zone are influenced independently of one another and the adjusting and correcting possibilities for the folding width are improved.

In particular, the lengthwise folding machine in accordance with the present invention is provided with a conically extending folding mandrel arranged adjustably under a plane of the web edge extending between a height-adjustable drawing-in roller and a first withdrawing roller, a conical tip of the folding mandrel forms a harmonous transition to a folding edge of a guiding plate, and a guiding rod is arranged so that it extends over the guiding plate diagonally from the folding mandrel to the region behind the line of intersection of the web edge and the withdrawing roller.

In accordance with another feature of the invention, the conical tip of the folding mandrel has a lower side which extends parallel to the guiding plate.

Still a further feature of the present invention is that the folding mandrel and the guiding rod together with a guiding plate are laterally adjustable via a spindle, and the folding mandrel is finely longitudinally, vertically and turnably adjustable and arrestable by a turning and clamping connection.

Also, in accordance with yet another feature of the present invention the drawing-in roller is height-adjustable and arrestable with the aid of two guiding spindles, independently of the adjustability of the folding elements.

When the lengthwise folding arrangement is designed in accordance with the present invention it provides for the advantage that the geometrical shape of the folding elements can corrected or changed by fine and all-sided variability of the position of the conical tip of the folding mandrel so that it can be adjusted to different types of paper, etc. Thereby the web forces can be taken better than before and the web tensions in the web and in the folding zone are influenced independently of one another. Because of the proposed structural features, a better web running is guaranteed and flextures in the folding zone are completely avoided.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
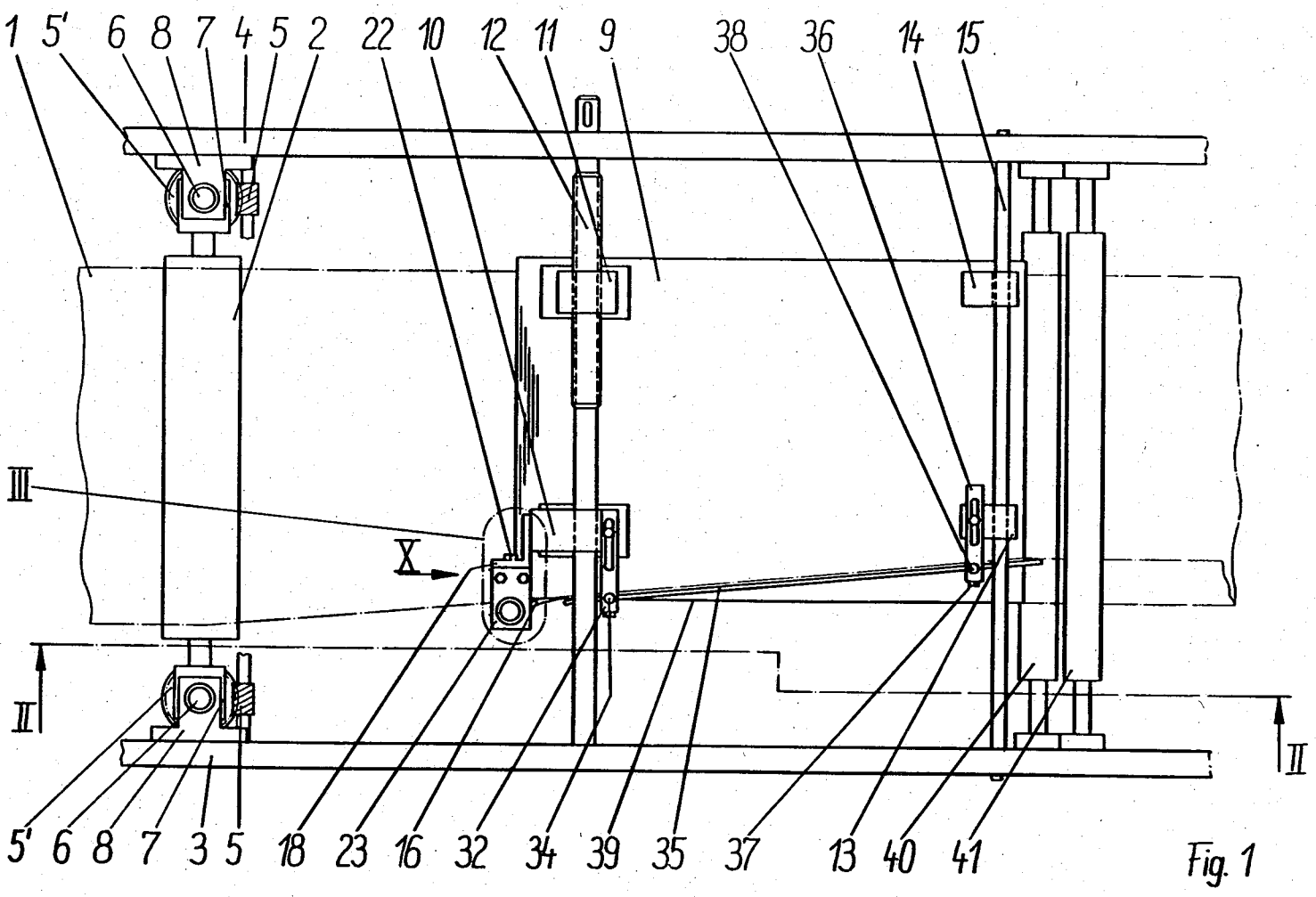
FIG. 1 is a partially schematic plan view of a lengthwise folding arrangement in accordance with the present invention.
Figure 2:
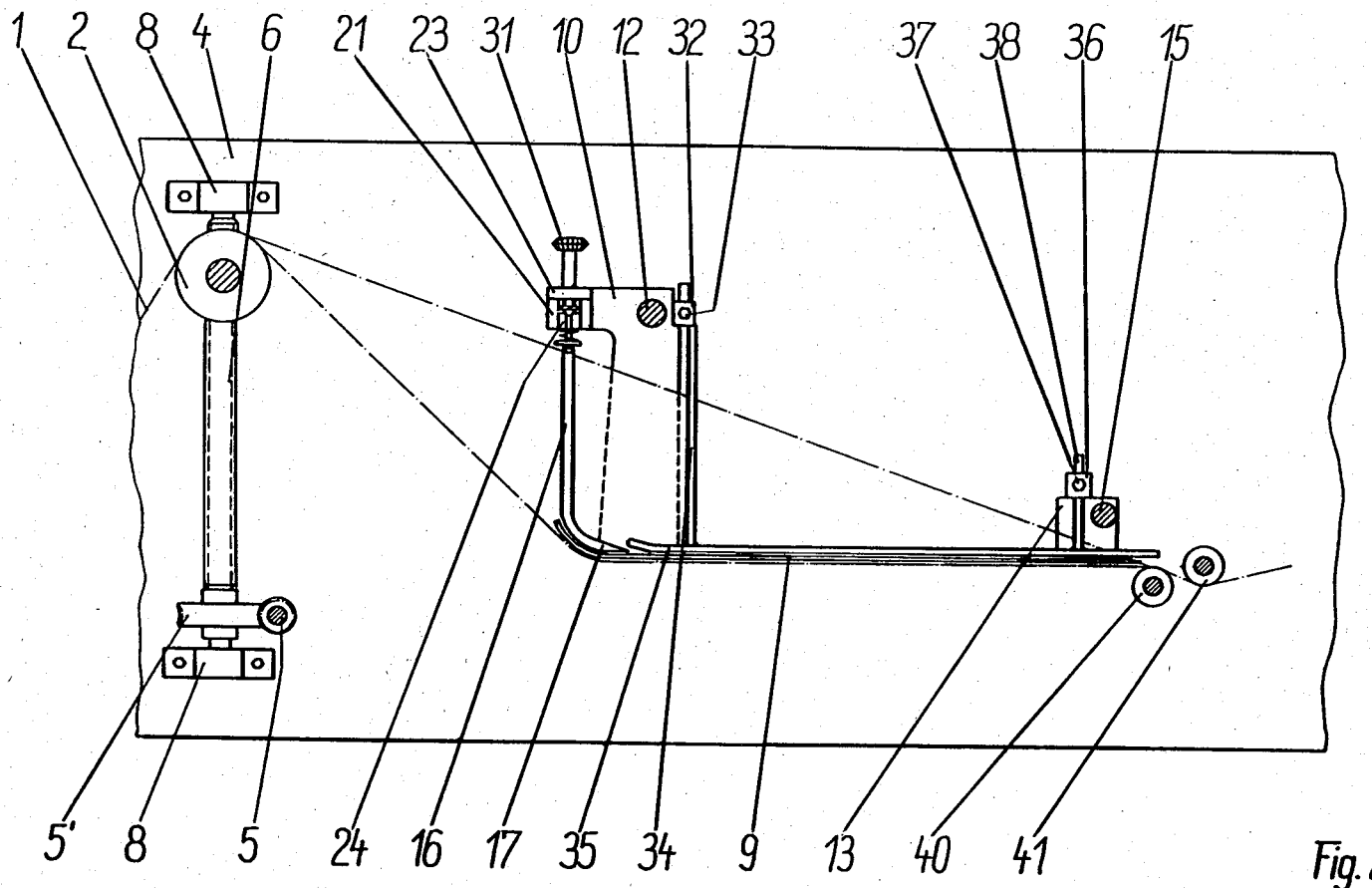
FIG. 2 is a side view taken along the line II—II in FIG. 1.

A paper web or a web of another material 1 is supplied from a not shown rotary printing machine via a drawing guide roller 2 to a lengthwise folding arrangement located between machine wells 3 and 4.

The drawing guide roller 2 is vertically adjustable in a known manner. Its adjustment is performed in a motor-driven manner via a worm transmission which includes a worm 5 and a worm gear 5'. Each worm gear 5' at each side is connected with a spindle 6 which is lifted or lowered in dependence on the direction of rotation of a spindle nut 7. The spindle nut 7 is fixedly connected with a spindle and guide roller bearing 8.

Figure 3:
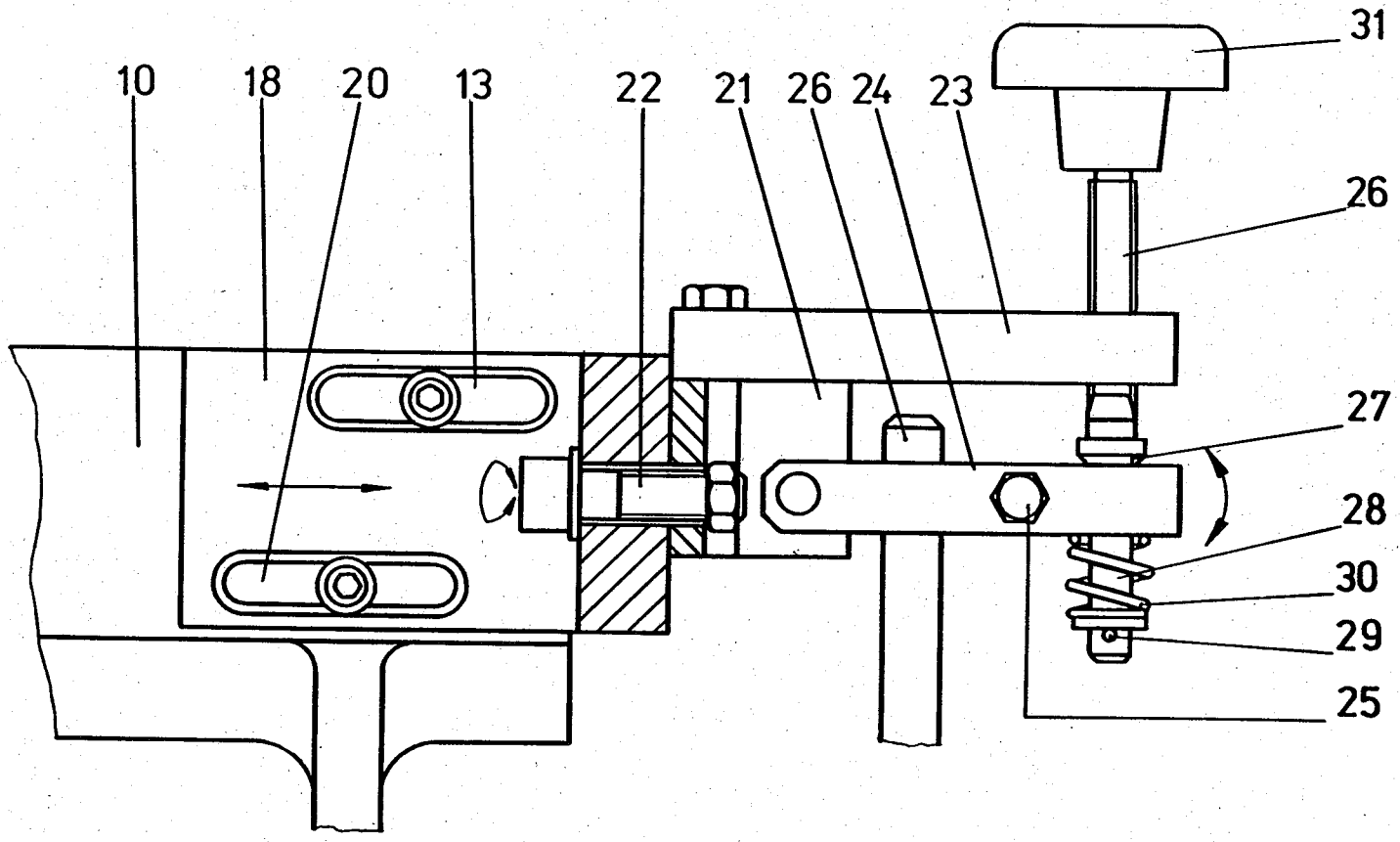
FIG. 3 is a view showing a fragment III in FIG. 1, as seen in direction of the arrow X.

Depending upon the folding width, the web 1 is guided partially over a guiding plate 9. The guiding plate 9 is supported displaceably on a shaft 12 with the aid of two bearing blocks 10 and 11 in a known manner and is guided in two guides 13 and 14 which slide over a traverse 15. The part of the web to be folded projects in an unfolded condition beyond the guiding plate 9. For displacing of the guiding plate 9, the bearing block 11 is provided with a threaded hole which runs on a threaded part of the shaft 12, so that by rotation of the shaft 12 with the aid of a hand wheel or a motor a format-dependent lateral adjustment of the guiding plate 9 is performed. Folding of the web 1 is not produced, however, as in the prior art from an edge of the guiding plate 9. Instead, for this purpose in accordance with the invention, there is provided a folding mandrel 16 having a conical tip 17. The folding mandrel 16 is mounted finely adjustably on the bearing block 10. For this purpose an angle 18 is laterally adjustably mounted on the bearing block 10 with the aid of two elongated holes 19 and 20 in respective screws. The angle 18 carries a fork-shaped adjusting block 21 which is rotatable and fixable relative to the angle 18 with the aid of a threaded set bolt 22, as particularly shown in FIG. 3.

A plate 23 is mounted on the adjusting block 21 and moreover turnably supports a holder 24 of the folding mandrel. The folding mandrel 16 is received in the holder 24 composed of two rods and arrested with the aid of a clamping screw 25. For fine adjustment of the folding mandrel 16, a screw 27 is provided in the fixed plate 23 and has in the region of the folder 24 a cone 27 which merges into a pin 28. A pressure spring 30 is held on the lower end of the pin 28 by a key. The holder 24 is pressed against the cone 27 by the pressure spring 30. By turning of an adjusting bottom 31 the holder 24 and thereby the folding mandrel 16 can be brought by the screw 26 with high accuracy to the desired position.

A holding member 32 is also mounted on the bearing block 10 and adjustably receives a front rod holder 34 with the aid of a clamping screw 33. A guiding rod 35 is mounted at the lower side of the rod holder 34. A further holding member 36 is similarly mounted on the guide 13, and a rod holder 38 connected with a guiding rod 35 in the rear region is supported vertically adjustable and arrestable by a screw 37. The guiding rod 35 is provided in the region of the folding mandrel 16 with a light insertion curve and extends diagonally from the conical tip 17 of the folding mandrel 16 to the rear side of a withdrawing roller. The angle between a folding line 39 and the guiding rod 35 is selected in dependence on the folding width. For fixing the fold, a counter roller 41 is arranged after the withdrawing roller 40.

Figure 4:
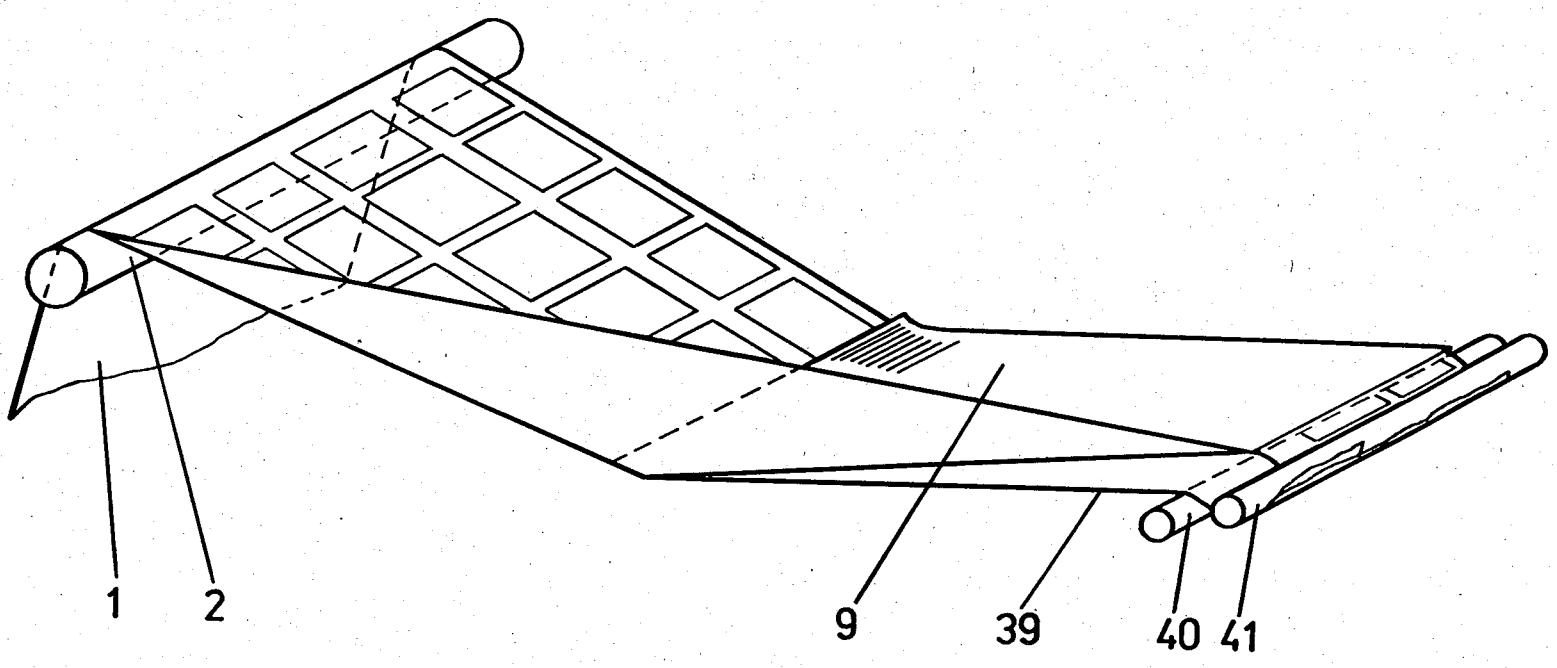
FIG. 4 is a perspective view showing the folding path.

From the drawing roller 2 on the fold part to be formed is lifted vertically first by 90°. For this purpose the folding mandrel 16 is provided with the conical tip 17 which forms a harmonous transition to the guiding plate 9 while the lower side of the conical tip 17 of the folding mandrel 16 extends parallel to the lower side of the guiding plate 9. By the diagonal arrangement of the guiding rod 35 the fold part is then gradually inclined continuously by further 90°, and then the folding ends in the region of the withdrawing roller 40, as can be seen from the perspective view of FIG. 4.

It will be understood that each of the elements described above, or two or more together, may also find a useful application in other types of constructions differing from the types described above.

While the invention has been illustrated and described as embodied in a lengthwise folding arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A lengthwise folding arrangement for webs, comprising a rotatable vertically adjustable drawing-in roller; a horizontal guiding plate forming a folding edge; a rotatable withdrawing roller; a conically extending folding mandrel arranged adjustably under a plane of a web edge extending between said vertically adjustable drawing-in roller and said withdrawing roller, said folding mandrel having a conical tip which forms a harmonious transition to said folding edge of said guiding plate; and a guiding rod arranged over said guiding plate diagonally from said folding mandrel to a rear side of a line of intersection of the web edge and said withdrawing roller; means for vertically adjusting said drawing-in roller; and means for vertically adjusting said conical tip of said folding mandrel.

2. A lengthwise folding arrangement as defined in claim 1, wherein said drawing-in roller is arranged so that it is vertically adjustable; and further comprising means for vertically adjusting said drawing-in roller.

3. A lengthwise folding arrangement as defined in claim 1, wherein said guiding plate is laterally adjusted; and further comprising means for laterally adjusting said guiding plate.

4. A lengthwise folding arrangement as defined in claim 1, wherein said guiding plate is provided with an insertion curve.

5. A lengthwise folding arrangement as defined in claim 1, wherein said means for independently vertically adjusting and arresting said drawing-in roller includes two spindles.

6. A lengthwise folding arrangement for webs, comprising a rotatable drawing-in roller; a horizontal guiding plate forming a folding edge; a rotatable withdrawing roller; a conically extending folding mandrel arranged adjustably under a plane of a web edge extending between said drawing-in roller and said withdrawing roller, said folding mandrel having a conical tip which forms a harmonous transition to said folding edge of said guiding plate, said conical tip of said folding mandrel having a lower side which extends parallel to said guiding plate; and a guiding rod arranged over said guiding plate diagonally from said folding mandrel to a rear side of a line of intersection of the web edge and said withdrawing roller.

7. A lengthwise folding arrangement for webs, comprising a rotatable drawing-in roller; a horizontal guiding plate forming a folding edge; a rotatable withdrawing roller; a conically extending folding mandrel arranged adjustably under a plane of a web edge extending between said drawing-in roller and said withdrawing roller, said folding mandrel having a conical tip which forms a harmonous transition to said folding edge of said guiding plate; a guiding rod arranged over said guiding plate diagonally from said folding mandrel to rear side of a line of intersection of the web edge and said withdrawing roller; and a shaft having a portion provided with a thread and arranged so that said folding mandrel and said guiding rod together with said guiding plate are laterally adjustable on said shaft.

8. A lengthwise folding arrangement for webs, comprising a rotatable drawing-in roller; a horizontal guiding plate forming a folding edge; a rotatable withdrawing roller; a conically extending folding mandrel arranged adjustably under a plane of a web edge extending between said drawing-in roller and said withdrawing roller, said folding mandrel having a conical tip which forms a harmonous transition to said folding edge of said guiding plate; a guiding rod arranged over said guiding plate diagonally from said folding mandrel to a rear side of a line of intersection of the web edge and said withdrawing roller; and turning and clamping means arranged so that said folding mandrel is finely longitudinally, vertically and turnably adjustable and arrestable.

9. A lengthwise folding arrangement for webs, comprising a rotatable drawing-in roller; a horizontal guiding plate forming a folding edge; a rotatable withdrawing roller; a conically extending folding mandrel arranged adjustably under a plane of a web edge extending between said drawing-in roller and said withdrawing roller, said folding mandrel having a conical tip which forms a harmonous transition to said folding edge of said guiding plate; a guiding rod arranged over said guiding plate diagonally from said folding mandrel to a rear side of a line of intersection of the web edge and said withdrawing roller, said folding mandrel, said guiding plate and said guiding rod forming folding elements, said drawing-in roller being vertically adjustable and arrestable independently of said folding elements; and means for independently vertically adjusting and arresting said drawing-in roller.

* * * * *